US010991381B2

(12) United States Patent
Haines et al.

(10) Patent No.: US 10,991,381 B2
(45) Date of Patent: Apr. 27, 2021

(54) SYSTEM AND METHOD FOR MACHINE LEARNING PREDICTIVE MAINTENANCE THROUGH AUDITORY DETECTION ON NATURAL GAS COMPRESSORS

(71) Applicant: WELL CHECKED SYSTEMS INTERNATIONAL LLC, Prague, OK (US)

(72) Inventors: Michael David Haines, Stroud, OK (US); Samuel Henry Haines, III, Tulsa, OK (US); Hayden Taylor Haines, Sparks, OK (US)

(73) Assignee: WELL CHECKED SYSTEMS INTERNATIONAL LLC, Prague, OK (US)

( * ) Notice: Subject to any disclaimer, the term of this patent is extended or adjusted under 35 U.S.C. 154(b) by 0 days.

(21) Appl. No.: 16/379,411

(22) Filed: Apr. 9, 2019

(65) Prior Publication Data

US 2019/0311731 A1 Oct. 10, 2019

Related U.S. Application Data

(60) Provisional application No. 62/655,017, filed on Apr. 9, 2018.

(51) Int. Cl.

| | |
|---|---|
| ***G10L 25/51*** | (2013.01) |
| ***H04R 3/00*** | (2006.01) |
| ***H04R 1/40*** | (2006.01) |

(52) U.S. Cl.

CPC ..... *G10L 25/51* (2013.01); *H04R 1/406* (2013.01); *H04R 3/005* (2013.01)

(58) Field of Classification Search

CPC ..... H04R 3/005; H04R 1/406; G10L 25/51

(Continued)

(56) References Cited

U.S. PATENT DOCUMENTS

| | | |
|---|---|---|
| 9,659,149 B2 | 5/2017 | Kohlrausch et al. |
| 9,894,741 B2 | 2/2018 | Flinsenberg et al. |

(Continued)

FOREIGN PATENT DOCUMENTS

| | | |
|---|---|---|
| CN | 1417961 | 5/2003 |
| CN | 1811367 | 8/2006 |

(Continued)

OTHER PUBLICATIONS

Bong, Jun Ko, et al., Demo Abstract: Acoustic Signal Processing For Anomaly Detection in Machine Rook Environments, Nov. 16, 2016, https://researcher.watson.ibm.com/researcher/files/uswangshiq/Buildsys2016.pdf.

(Continued)

*Primary Examiner* — Paul Kim

(74) *Attorney, Agent, or Firm* — Margaret Millikin

(57) ABSTRACT

A system, method and computer program for predictive maintenance on natural gas compressors through auditory detection. Using one or multiple microphones, a system will collect and evaluate sound waves for the purpose of predicting and detecting failures and alert conditions in mechanical and process equipment. The system will collect sound which is used in a machine learning environment to utilize supervised training as well as unsupervised training, to produce a normal baseline and detect abnormal operations. Additionally, abnormal operations are categorized against known conditions. For uncategorized and unknown conditions, a workflow is in place to allow for the retraining and learning" of new conditions which are then published to the entire network of devices.

20 Claims, 10 Drawing Sheets

(58) Field of Classification Search
USPC ..... 381/56
See application file for complete search history.

(56) References Cited

U.S. PATENT DOCUMENTS

| | | | | |
|---|---|---|---|---|
| 9,971,667 | B1 | 5/2018 | Jenkins et al. | |
| 10,080,090 | B2 | 9/2018 | Park et al. | |
| 10,145,761 | B1 | 12/2018 | Jenkins et al. | |
| 10,242,319 | B2 | 3/2019 | Cheng et al. | |
| 2006/0259198 | A1 | 11/2006 | Brcka et al. | |
| 2007/0223773 | A1* | 9/2007 | Tripp | H04R 1/342 381/399 |
| 2015/0382116 | A1* | 12/2015 | Van Gerwen | H04R 25/453 600/25 |
| 2016/0277863 | A1* | 9/2016 | Cahill | H04R 3/005 |
| 2017/0293862 | A1 | 10/2017 | Kamiya et al. | |
| 2018/0096261 | A1 | 4/2018 | Chu et al. | |
| 2020/0033297 | A1 | 1/2020 | Rudyk et al. | |

FOREIGN PATENT DOCUMENTS

| | | |
|---|---|---|
| DE | 102007051261 | 4/2009 |
| EP | 2696344 | 12/2014 |
| WO | 2017112591 | 6/2017 |
| WO | 2017163153 | 9/2017 |

OTHER PUBLICATIONS

Pramuditha Perera, Student Member, IEEE, and Vishal M. Patel, Senior Member, IEEE, Learning Deep Features for One-Class Classification, Abstract, arXiv:1801.05365v1, Jan. 16, 2018, 12 pages.

* cited by examiner

Location Overview

NW Oklahoma Location

Recent Events:
04/02/2019 08:15:22
04/01/2019 23:37:18

Personnel Assigned:
Steven Mathers - Foreman
Paulie Risotonni - Mechanic

Burschowitz Location

Recent Events:
02/15/2019 10:17:28

Personnel Assigned:
Anna Reese - Lease Operator
David O'Brien - Mechanic

Devil Creek Location

Recent Events:
03/15/2019 11:21:49

Personnel Assigned:
Steven Mathers - Foreman
David O'Brien - Mechanic
Richard Davis - Lease Operator

SW Oklahoma Location

Recent Events:
03/25/2019 22:05:15

Personnel Assigned:
David O'Brien - Mechanic

FIG. 8

Categorized Issues

SW Oklahoma Location

Bearing issue:

03/25/2019 22:05:15

Assigned: Paulie Risotonni 03/25/2019
Status: Resolved

04/03/2019 08:15:15

Assigned: Paulie Risotonni 04/04/2019
Status: Verified

Seal failure:

11/04/2018 12:15:05

Assigned: Steve Mathers 11/05/2018
Status: Resolved

03/11/2019 15:05:59

Assigned: Paulie Risotonni 03/13/2019
Status: Verified, Maintenance Scheduled

Unclassified:

01/11/19 11:43:19

Assigned: Steve Mathers 11/13/2019
Status: Resolved

02/22/19 22:41:35

Assigned: Paulie Risotonni 02/23/2019
Status: Resolved

FIG. 9

Sound Classification

Microphone: Suction Cylinder

Type: Seal Failure ⇩ + add new type

Listen

Date: 03/25/19

Location: Burschowitz

Urgent?: [X]

Description:

Mechanic performed a diagnostic and found a cylinder seal leak beginning to form. Maintenance is scheduled for 4/02

SYSTEM AND METHOD FOR MACHINE LEARNING PREDICTIVE MAINTENANCE THROUGH AUDITORY DETECTION ON NATURAL GAS COMPRESSORS

CROSS-REFERENCE TO RELATED APPLICATIONS

This patent application is based on and claims priority to U.S. provisional patent application Ser. No. 62/655,017, which is entitled System and Method for Machine Learning Predictive Maintenance Through Auditory Detection on Natural Gas Compressors, filed Apr. 9, 2018, the entire disclosure of which is incorporated herein by reference.

TECHNICAL FIELD OF THE INVENTION

The present invention relates generally to systems and method for predictive maintenance of equipment and, more particularly, to a system of predictive maintenance on natural gas compressors through auditory detection, and a computer product therefor. Methods of predictive maintenance on natural gas compressors through auditory detection also are disclosed.

SUMMARY OF THE INVENTION

The present invention is directed to a system for predictive maintenance for a unit of equipment through auditory detection of anomalies in a hazardous environment. The system comprises a microphone system comprising a number of microphones N for collecting auditory data in two dimensional images from the unit of equipment, wherein N is ≥1; a central processor or storage medium for storing the auditory data in two-dimensional sound files; a processor for dividing the two-dimensional sound files into segments, transforming the segments of two-dimensional sound files into three-dimensional sound images and conditioning the three-dimensional sound images in an overlay pattern so that each collected item of auditory data is evaluated multiple times; and a library of baseline normal operating sounds comprising the three-dimensional sound images; wherein anomalies in the hazardous environment are determined by classifying the three-dimensional sound images gathered by the at least one microphone against the library of baseline normal operating sounds to determine whether a sound image is problematic, benign or unclassified.

The present invention further is directed to a computer software program stored on a non-transitory computer readable recording medium, which, when executed, performs a method of predicting maintenance for a unit of equipment through auditory detection in a hazardous environment. The computer program, when executed performs a method comprising the steps of collecting auditory data from the unit of equipment via at least one microphone; storing the auditory data as two-dimensional sound files in a central processor or storage medium; dividing the two-dimensional sound files into segments; transforming the segments of two-dimensional sound files into three-dimensional sound images and conditioning the three-dimensional sound images in an overlay pattern so that each collected item of auditory data is evaluated multiple times; and creating a library of baseline normal operating sounds comprising the three-dimensional sound images for the unit of equipment.

The invention further is directed to a method of predicting maintenance for a unit of equipment through auditory detection in a hazardous environment. The method comprises the steps of collecting auditory data from the unit of equipment via at least one microphone; storing the auditory data as two-dimensional sound files in a central processor or storage medium; dividing the two-dimensional sound files into segments; transforming the segments of two-dimensional sound files into to three-dimensional sound images and conditioning the three-dimensional sound images in an overlay pattern so that each item of auditory data is evaluated multiple times; and creating a library of baseline normal operating sounds comprising the three-dimensional sound images for the unit of equipment.

BRIEF DESCRIPTION OF THE DRAWINGS

FIG. 8 is a screenshot of the computer program of the present invention showing an alert workflow, a sound classified with an abnormal classification and a severity matrix for the sound.

FIG. 9 is a flow chart showing a method of determining predictive maintenance using auditory sounds according to the method of the present invention.

DETAILED DESCRIPTION OF THE INVENTION

Figure 1:
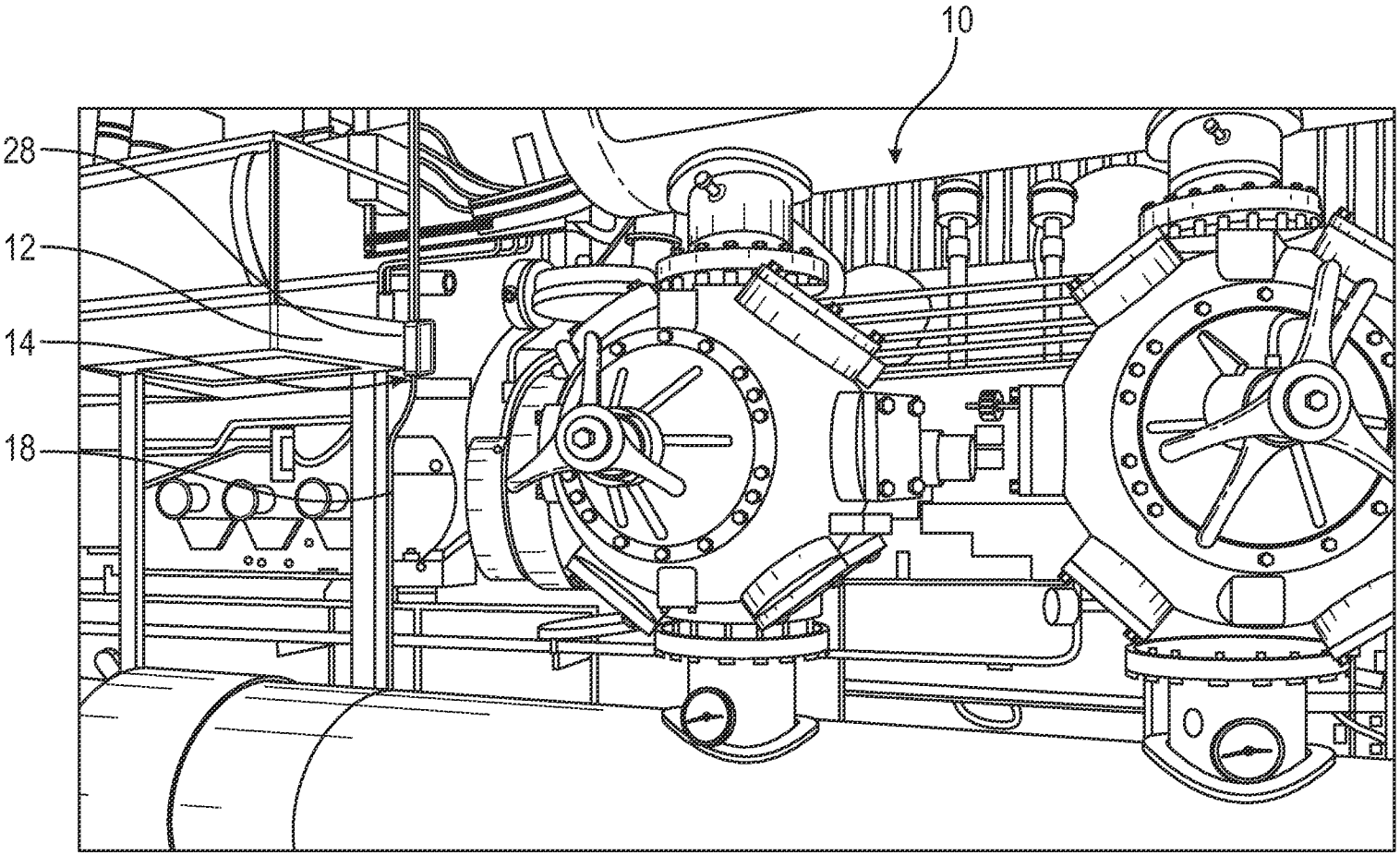
FIG. 1 is an exemplary enclosure for the system of the present invention, the enclosure housing a microphone that does not require phantom power and is attached to the frame via magnets within a seat tight hermetically sealed flexible conduit for quick removal

Sound analysis is adaptable for use as a non-intrusive vibration analysis in complex systems, including, for example, natural gas compressors and other types of equipment. Dictionaries, or libraries of sounds which are caused by anomalous behaviors within a machine, may be detected, collected and classified. The detected sounds, and their collection and classification, can be used to predict maintenance requirements of equipment before the occurrence of a mechanical failure, which permits operators to prevent or correct mechanical issues before they become costly or disastrous and cause facility, plant or line closures, personal injury or even death, in extreme circumstances.

The invention has particular, although not exclusive, application to compressor stations, also known as pumping stations, for natural gas transportation. Natural gas transported through a pipeline must be pressurized at determined intervals, depending upon the terrain, the number of oil and gas wells in the vicinity feeding the pipeline and elevation changes, for example. The compressor station compresses the natural gas transported through the pipeline, thereby increasing its p and providing energy to move the gas through the pipeline. Each compressor station along a pipeline generally comprises one more compressor units. The size of the compressor station, and the number of compressor units located at each compressor station, will vary based on a variety of factors, including the diameter of the pipeline and the volume of gas transported through the pipeline.

Compressor stations may house multiple compressor units within a single facility or building. Within single compressor unit, multiple systems are at work, which may include (i) a power system, having an engine or electric motor, (ii) a compressor system, comprising a crank and one or multiple compression cylinders, and (iii) a cooling system, comprising a fan and water pump. The proximity of these systems within each compressor unit contributes noise polluting audio levels to other systems also contained within the compressor unit. The compressor unit may further comprise multiple subsystems, including a crankcase, a valve body and a turbo unit. Each subsystem adds ambient noise pollution contributed by the over system of the compressor unit.

The ambient sound within a compressor facility comprises high volumes of noise across many frequencies and, therefore, complicates the analysis of auditory data. The ambient sounds within a compressor station can exceed 150 Db. This continuous onslaught of extreme sound levels exacerbates the complexities of sound collection and identification. The nature of sound waves from one compressor unit pollute the audio of another compressor unit, which further complicates the collection and analysis of auditory data. Often, the excessive levels of noise prevent detection of new or abnormal sounds by the human ear.

The present invention solves these problems and more. The present invention introduces a novel system and method for the deployment of select microphones throughout the compressor unit and for the collection, analysis, processing and distribution of auditory data for machine learning predictive maintenance through auditory detection. The present invention further comprises a software program directed to the collection, analysis, processing and distribution of auditory data for machine learning predictive maintenance through auditory detection.

The present invention collects audio signals, which are converted into a three-dimensional waveform images or videos. Using one or multiple microphones, auditory data are collected and evaluated for the purposes of predicting and detecting failures and alert conditions in mechanical and/or process equipment. The auditory data is used in a machine learning environment to utilize supervised training as well as unsupervised training. The purpose is to produce a normal baseline for the unit of equipment and, therefore, detect "abnormal" operation. Additionally, "abnormal" operation is then categorized against known conditions. For uncategorized and unknown conditions, a workflow is in place to allow for the retraining and learning of new conditions which are then published to the entire network of devices.

Turning now to the drawings in general and to FIG. 1 in particular, there is shown therein a compressor unit 10. The compressor unit is attached to and/or supported by a frame 12. The frame 12 of the compressor unit 10 also supports the various systems and subsystems necessary for the operation of the compressor unit. A microphone system 14 is installed either integral with or adjacent to the compressor 10. It will be appreciated that a plurality of microphone systems 14 may installed either integral with or adjacent to the various systems and subsystems of the compressor unit 10.

The compressor unit 10 is situated at a compressor station, which is considered a harsh environment and is classified as a Class 1 Division 2 hazardous location. Some compressor units are outdoors in the presence of hydrocarbons, hazardous gasses and chemicals. Compressor units are cleaned with a high-pressure steam system that produces significant ambient heat. Accordingly, the microphone system 14 must be hermetically sealed to protect it from heat, hazardous substances, dirt, chemicals, liquids and other pollutants.

Figure 2:
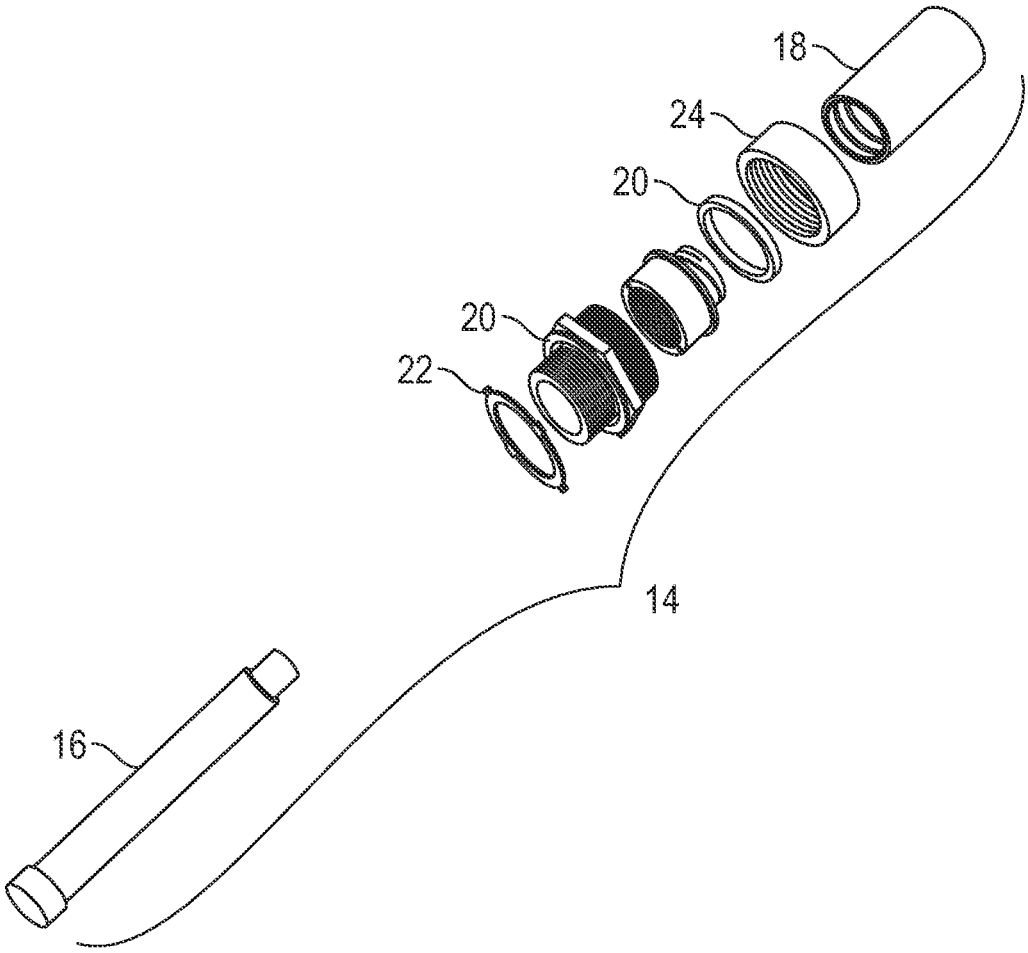
FIG. 2 is an exemplary microphone system of the present invention.

Turning now to FIG. 2, the microphone system 14 comprises a microphone 16 that withstands Class 1 Division 2 environments or Class 1 Division 1 environments. The microphone 16 preferably is Hazardous Areas & Explosive Atmospheres compliant and can safely be employed in gaseous hazardous environments where standard microphones may cause a spark and fire. The microphone 16 possesses 15 dB to 150 dB capability and a sensitivity between 10-60 mV/Pa. One such microphone 16 suitable for use in the present invention is the PCI® Model No. EX378B02 microphone.

The microphone 16 may be sealed or enclosed to maintain a class rating, or at least hermetically sealed against elements both natural and synthetic, for use in hazardous environments. In one embodiment of the invention, the microphone system 14 comprises a liquid tight conduit 18, as for example, a flexible, liquid-tight, metallic conduit with interlocking galvanized steel surrounded by a polyvinylchloride jacket, such as seal tight hermetically sealed flexible conduit. The conduit 18 alternatively may comprise a threaded rigid conduit. It will be appreciated that conduit 18 may comprise any material imparting strength and water resistance, including galvanized steel, nylon, polyvinylchloride, plastics, metals and combinations thereof.

In another embodiment, the microphone system 14 does not comprise a conduit 18 at all; rather, sealed cable(s) is run to the microphone 16, which is enclosed within a CGB cable grip.

In yet another embodiment, the microphone 16 is housed inside a hermetically sealed enclosure 28, and may further be padded with foam or other insulating material. The microphone system 14 may comprise an enclosure or housing 28 for holding and sheltering the microphone 16, as shown in FIG. 1, in which case the housing 28 is attached to the frame 12 using magnets (not shown) for quick removal and to the seal tight hermetically sealed flexible conduit 18. It will be appreciated that the microphone system 14 may be connected to the frame 12 or the compressor unit 10 via any suitable securing means. The microphone system 14 need not necessarily comprise a housing 28, in which case the microphone 16 may be situated directly inside the conduit 18 and may plug into an XLR jack or equivalent.

The microphone system 14 further comprises a plurality of seals 20, washers 22, and nuts or caps 24 for hermetically sealing the microphone 16 within the conduit 18 or housing 28.

Figure 3:
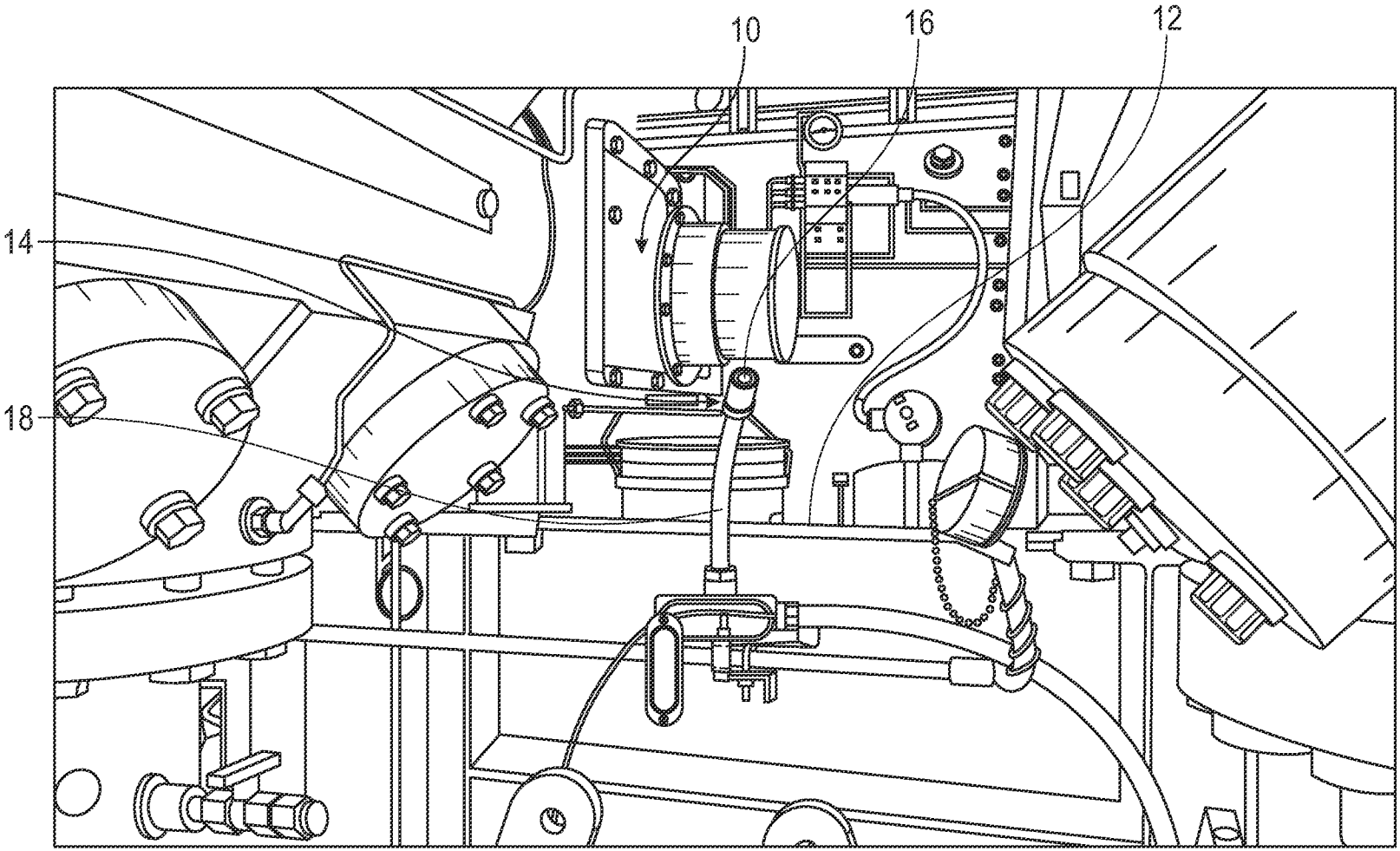
FIG. 3 is an exemplary microphone requiring phantom voltage housed inside the flexible seal tight conduit attached using a conduit Tee and flexible seal tight conduit for ease of removal during maintenance.
Figure 4:
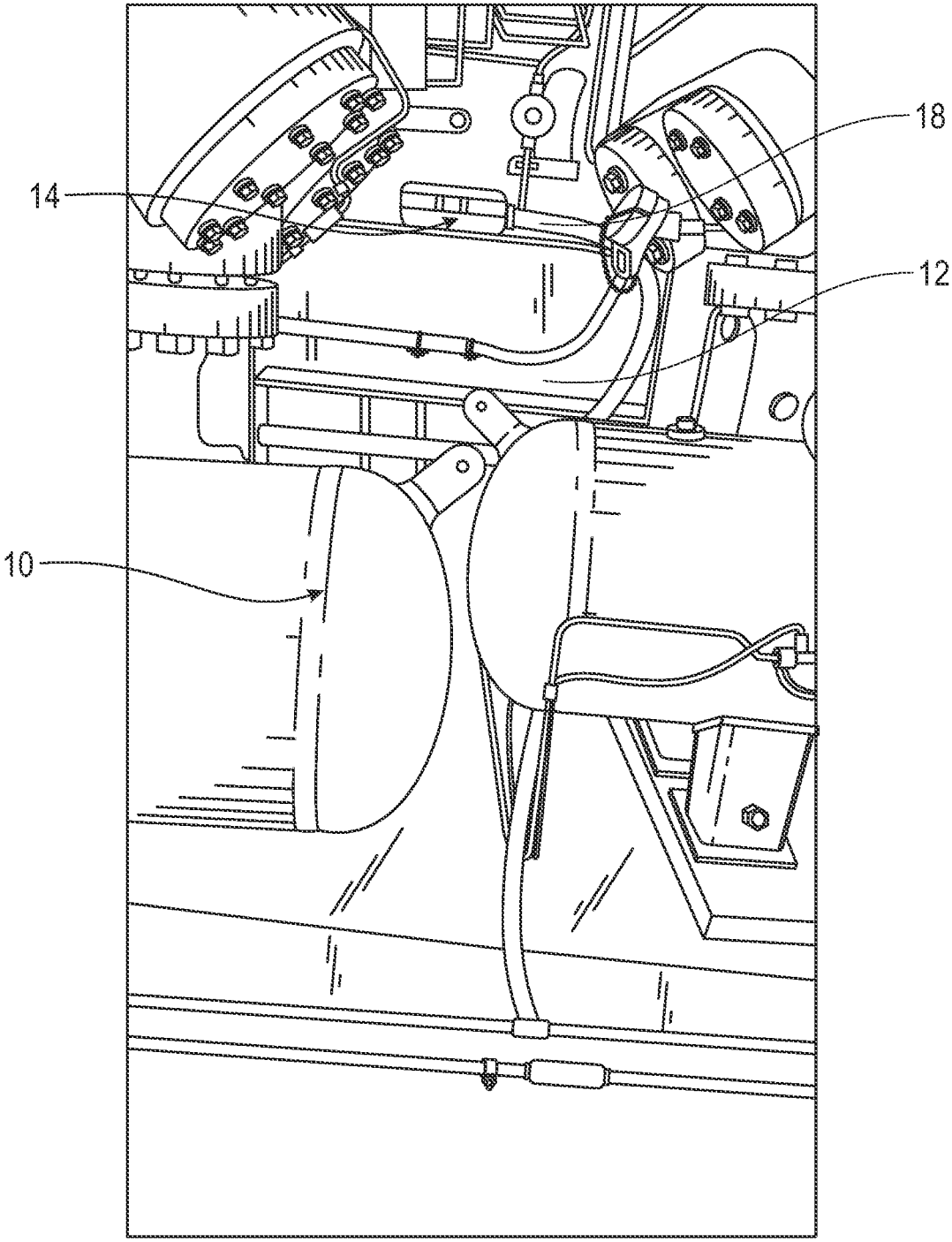
FIG. 4 is an exemplary installation showing the sealed conduit connected to flexible seal tight for easy removal.
Figure 5:
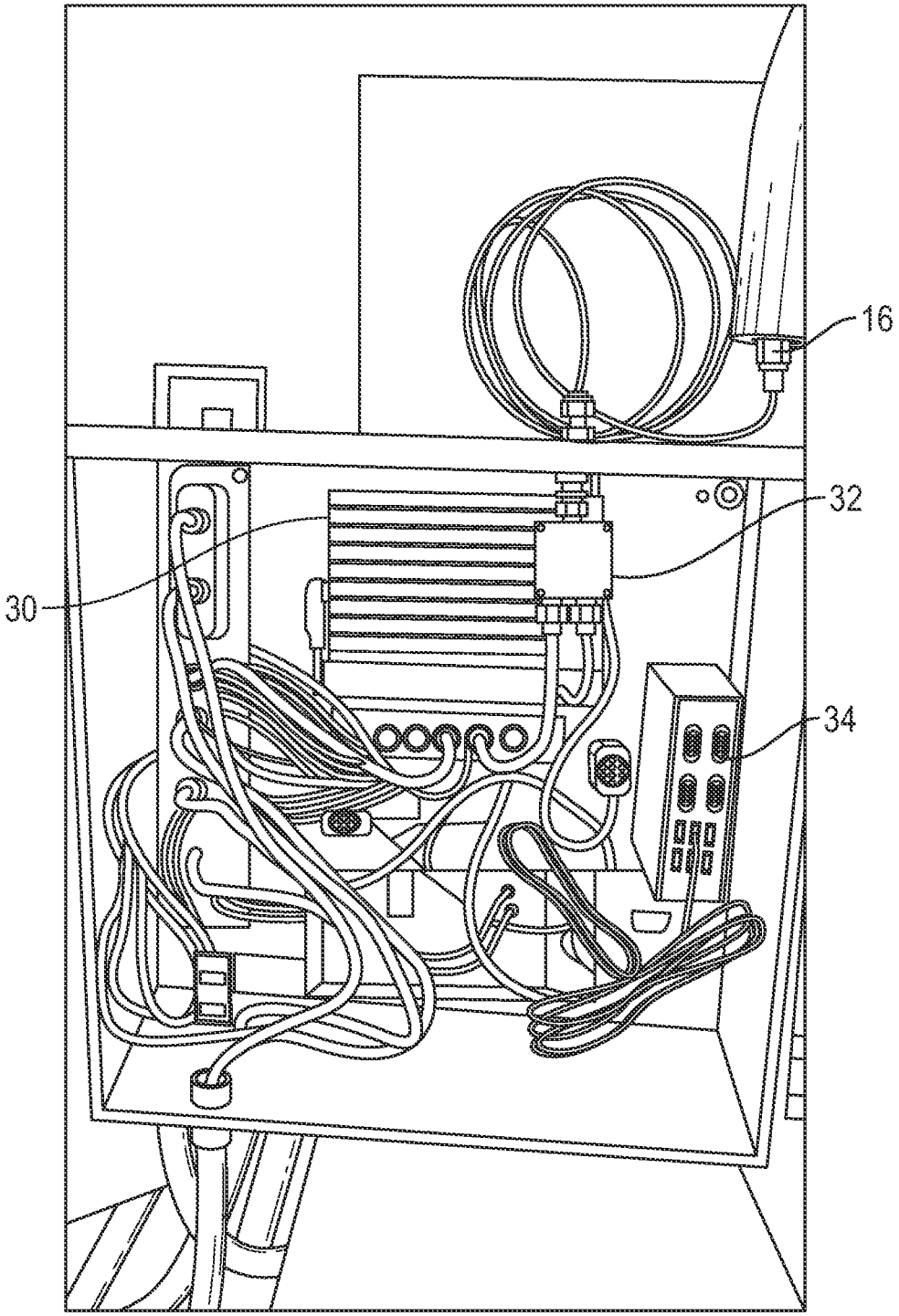
FIG. 5 is an exemplary installation enclosure for the system of the present invention in connection with local analysis including phantom power, XLR to USB Converter, USB Hub, and an embedded server.

The microphone 16 may operate with or without phantom power. As shown in FIG. 1, an enclosure 28 housing a microphone 16 that does not need phantom power to operate is attached to the frame 12 using magnets (not shown) and a seal tight hermetically sealed flexible conduit for quick removal. One example of a microphone that does not require phantom power and that is suitable for use with the present invention is a fiber optic microphone. Alternatively, the microphone 16 may require phantom power, as shown in FIG. 3, where the microphone is housed directly inside the conduit 18 and attached using a conduit Tee and flexible seal tight conduit 18 for easy removal during maintenance. In case, the microphone 16 may be padded with foam and housed in enclosure 28. An installation showing the sealed conduit connected to flexible seal tight for easy removal is illustrated in FIG. 4. Because maintenance and cleaning operations require the microphone 16 to be moved, the microphone preferably, though not necessarily, is mobile. An exemplary installation comprising an enclosure for local analysis is shown in FIG. 5 and includes a phantom power microphone 16, XLR to USB Converter 30, USB Hub 32, and an embedded server 34.

It will be appreciated that the present invention may comprise a plurality of microphones systems 14 which may be deployed throughout the frame 12 of the compressor unit 10, or integrated directly onto or into the compressor unit. The number of microphone systems 14 is a function of the number of systems and subsystems within the compressor unit. Within a single compressor unit 10, multiple systems are at work, which may include (i) a power system, having an engine or electric motor, (ii) a compressor system, comprising a crank and one or multiple compression cylinders, and (iii) a cooling system, comprising a fan and water pump. The proximity of these systems within each compressor unit contributes noise polluting audio levels to other systems also contained within the compressor unit. The compressor unit may further comprise multiple subsystems, including a crankcase, a valve body and a turbo unit. Each system or subsystem adds ambient noise pollution contributed by the over system of the compressor unit. Each microphone 16 should be placed in the best location to collect the sound from the system or subsystem to which the microphone is paired. Each subsystem may have more than one microphone 16. The microphone 16 need not necessarily be placed in the locations of each subsystem, but rather a pressure density microphone, similar to a stethoscope, could be employed, enabling access to a remote location and permitting sound to be carried through the tubing.

The number of microphones "N" must work together as an audio collection framework, whether that is within a single, vertically scaled collector or in an IOT horizontally scaled environment. As used herein, "IOT" means "Internet of Things" refers to a network of physical objects that feature an IP address for internet connectivity and the communication that occurs between these objects and other Internet-enabled devices and systems. The matrix of microphones systems 14 represents the totality of the overall system. If a single microphone 16 can provide the granularity necessary for analysis, then in that case, N=1.

Each microphone 16 converts the acoustical energy, or sound waves, emitted by the systems or subsystems of the compressor unit 10, into an audio signal, which is then converted into a three-dimensional waveform image or video in a manner yet to be described. Using one or multiple microphones, auditory data are collected and evaluated for the purposes of predicting and detecting failures and alert conditions in mechanical and/or process equipment, such as the compressor unit 10. The auditory data which is used in a machine learning environment to utilize supervised training as well as unsupervised training. The purpose is to produce a normal baseline for the unit of equipment and, therefore, detect "abnormal" operation. Additionally, "abnormal" operation is then categorized against known conditions. For uncategorized and unknown conditions, a workflow is in place to allow for the retraining and learning of new conditions which are then published to the entire network of devices.

Auditory data is continuously captured. As auditory data are captured and stored, those audio files are saved as sound segments. The time of the archived sound segments can vary but is generally around 15 seconds to two minutes in length. In one embodiment of the invention, the archived sound segments are about one minute in length. On average, approximately 1,440 sound files are produced each day per microphone each covering one minute of the day's auditory data. Once the auditory is captured and recorded for archive, it can be examined for anomalies.

In evaluating for anomalies, the data is conditioned in an overlay pattern. Each one-minute video sound archive is split into even smaller segments called segment windows, and each smaller segment window is produced into an image using Fourier transformation and/or sometimes convulsion filters. Three second segment windows work well, although the segment window may be about one second to about 15 seconds in length. Thus, the initial 60 second archived sound segment may be split into a series of about three second images. In the process of splitting the files, the audio file is progressed forward at a shorter interval than the length of the segment. For instance, if producing three second files, we would move forward one second between every image. Therefore, the first file produced is from second 0 through second 2. The second image produced would be from second 1 through second 3. The third image produced would be from second 2 through second 4, and so on. This produces 177 files per 60 second audio file. In doing so, the system 34 evaluates every sound multiple times in order to catch anomalous auditory data. The size of the segment window and the size of the overlay work together between the different microphones to catch issues and problems.

Audio context allows certain anomalies to be classified as benign or problems. Often a sound, in the context of other sounds, can point to a problem. But that same sound outside of the context would be benign or vise versa. In order to contextualize the sound, a known machine learning process called Long Short Term Memory ("LSTM") can be employed in the classification process and system 38. In order to perform this type of analysis, a multi-step process must be used for evaluating sound segments. For this reason, the raw sound file is used to transport the archived sound. If an anomaly is found in a three second segment of sound, the entire minute of sound is transported into the cloud 36 for further classification. In the classification process and system 38, that same audio file is split into multiple segments and formats and run through classification processes which include LSTM and do not include LSTM.

The Fourier Transform takes a time-based pattern, measures every possible cycle, and returns the overall "cycle recipe", such as the amplitude, offset, and rotation speed for every cycle that was found, using the following equations.

$$X_k = \sum_{n=0}^{N-1} x_n \cdot e^{-i2\pi kn/N} \quad \text{EQ1}$$

$$x_n = \frac{1}{N}\sum_{k=0}^{N-1} X_k \cdot e^{i2\pi kn/N} \quad \text{EQ2}$$

Fourier transformation allows a person to collect two-dimensional time-based patterns, such as sound, and transform them into three dimensional patterns such as a system of frequencies with amplitude over time. The resulting matrix of values can be represented in three dimensional images. An example of this is that the vertical or 'Y' axis is frequency, the 'X' axis is time and the pixel color or intensity 'Z' axis is amplitude. Using this method, images are produced corresponding to sound time segments and utilizing machine earning algorithms proven on image recognition for sound recognition.

Figure 6:
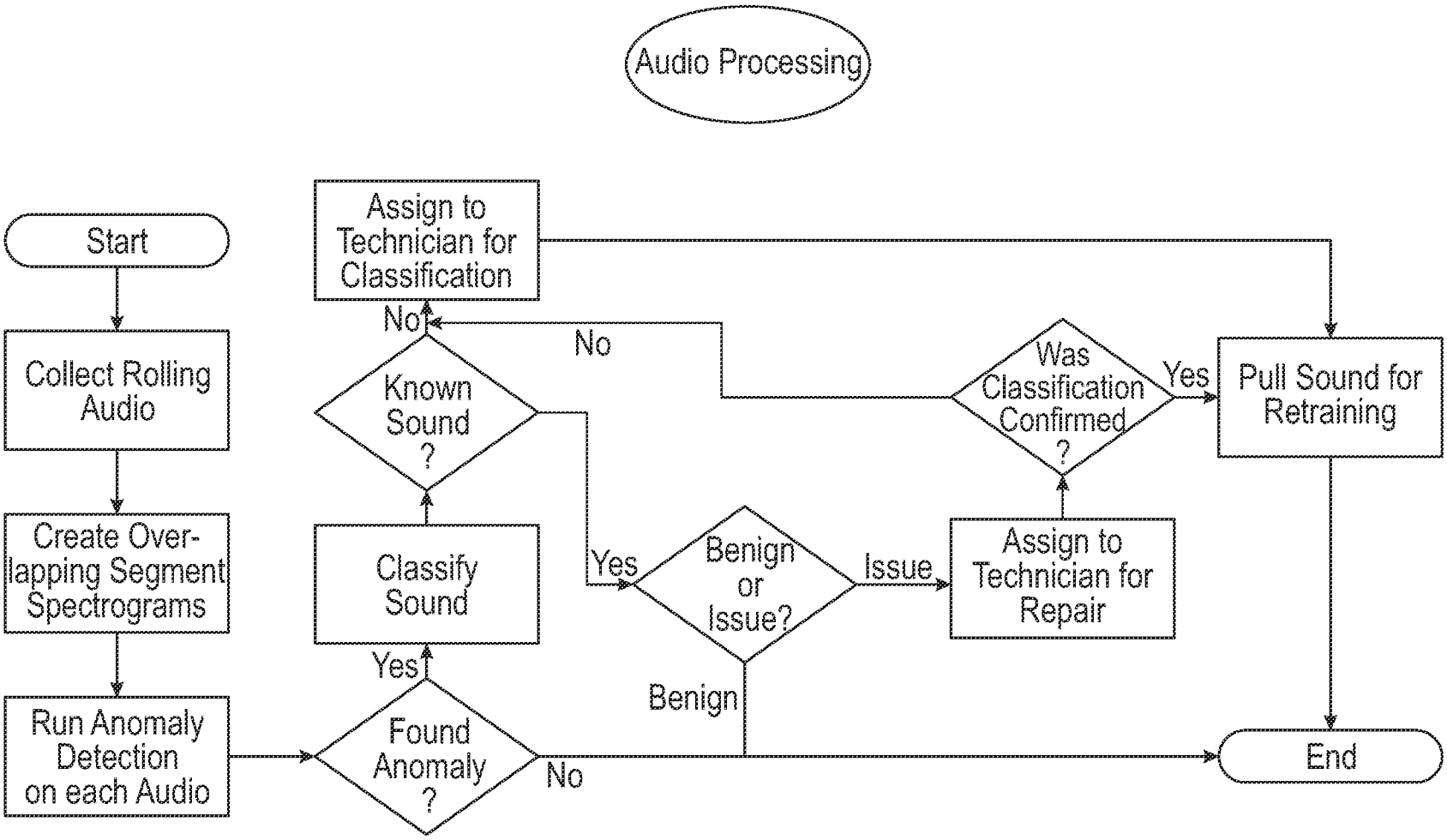
FIG. 6 is a screenshot of the software program of the present invention showing the location, assigned contacts and number of contacts for issues, roles and identification.
Figure 7:
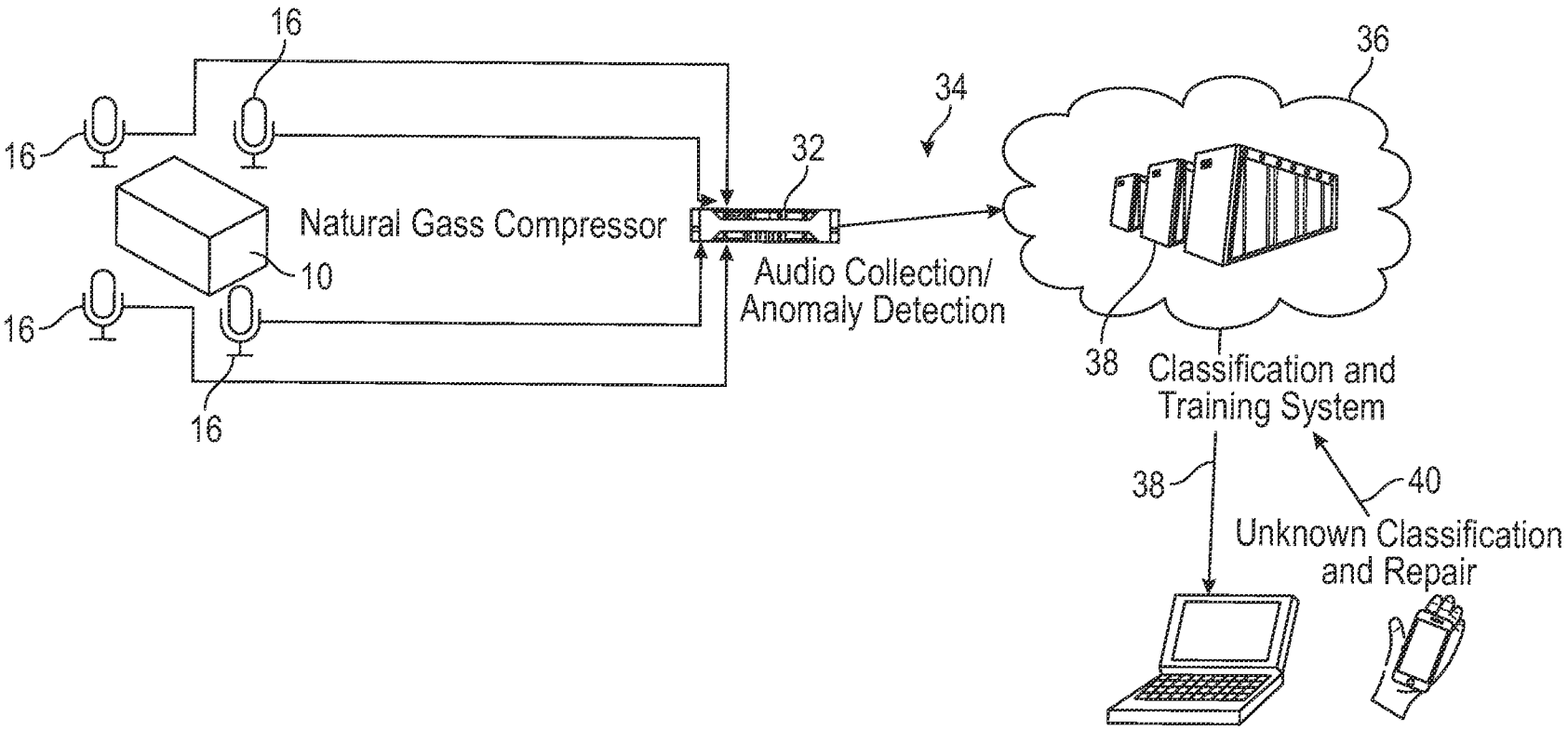
FIG. 7 is a screenshot of the computer program of the present invention showing classified and unclassified issues displayed for an assigned operator(s) and fed into the training operation for attention by the operators assigned to the identified role.

Turning now to FIGS. 6 and 7, each microphone collects auditory data from its associated system or subsystem of the compressor unit 10. A locally installed software application collects and stores continuous or sampled auditory data from each of the N microphones. The auditory data is stored according to its associated system or subsystem in segments on a continuous or periodic basis in a storage medium 32, such as a central processor.

Since analysis often must be conducted on multiple compressors 10 within a feedback structure, a cloud connection 36 is necessary or useful. The cloud connection 36 functions to transmit the collected auditory data from the microphone 16 into the cloud for further analysis, or it could function to push new models to the machine 10 for classification. The connection to the cloud 36 may be hard network, wired or wireless, or soft connection through update files being brought to the location where hard connections are not possible.

The cloud 36 must be able to collect all classified signatures for retraining and analysis. A central collection facility would allow the identified signatures to be retrained with all past signatures. Initially and over time, the compressor unit 10 will be dealing with unknown or unrecorded issues and is, therefore, unable to classify noises against signatures as a dictionary of issues has not been created. Each compressor unit 10 is in a different state of repair. Parts of the compressor unit 10 could be newly rebuilt, and another area could be very old and inefficient in operation. A certain amount of ambient sound dampening, whether digital or physical, should occur in order to isolate the sounds of the subsystem auditory data being collected. Because of the complexity of the patterns, the extreme nature of the sound, and the multiple frequencies at play, machine learning and complex artificially intelligent analysis must be performed.

The auditory data is collected and stored as two-dimensional sound files and converted to three-dimensional sound images as hereinbefore described. In order to build a library and catch new or different sounds from distinct hardware and situation, a process of anomaly detection must be employed. Often called one class classification, the process must learn "normal" and alert first on abnormal. This is a single class detection.

Anomalies can occur that are not considered problems or issues to be addressed. Where audio is concerned, people speaking near a machine is anomalous to the operation of the machine and at the same time benign. A secondary process of classification can identify anomalies which require attention and distinguish them from those which do not required attention.

Because not all sounds will have a classification, especially early on, a workflow process must be in place to allow anomalous auditory data to be classified and for that information to create a feedback loop into the system. This workflow must allow for additional data to be classified by machine, by subsystem and by issue.

The anomaly detection must be able to create a library comprising a baseline of normal operating sounds from the standpoint of a given machine, not a theoretical norm created in a factory. Therefore, there must be a supervised or unsupervised training mechanism for establishing normal on a given machine and subsystem.

Classification of anomalies must be multi-machine capable so that libraries can be developed that do not have to be recreated for each machine in the field. Therefore, the classification process and system 28 must include sounds from throughout a field of machines.

Collected sounds are analyzed for anomalous data against normal operation. Anomalies are referred to classification software to distinguish problematic, benign, and unclassified sounds from the heap. Each classified sound is classified against a problem or a benign occurrence. Unclassified auditory data is routed to those who can analyze either remotely or on site, the sound and provide a classification. Classifications can be updated at a later time. New or changed classifications are fed back into the training process to allow future classification specificity.

Using one or multiple microphones 16 or microphone systems 14, a system will collect and evaluate sound waves for the purpose of predicting and detecting failures and alert conditions in mechanical and process equipment. The system 34 will collect auditory data which is used in a machine learning environment to utilize supervised training as well as unsupervised training. The purpose is to produce a "normal" baseline and therefore detect "abnormal" operation. Additionally, "abnormal" operation is then categorized against known conditions. For uncategorized and unknown conditions, a workflow is in place to allow for the retraining and "learning" of new conditions which are then published to the entire network of devices.

Hardware

"N" number of microphones must matrix together in the audio collection framework whether that is within a single vertically scaled collector or in an IOT horizontally scaled environment. The matrix of microphones represents the totality of the machine. If a single microphone can provide the granularity necessary for analysis, then in that case, 'N'=1.

In order to seal the microphones against the environment and maintain a class rating, each microphone must either of design be sealed or be housed in a sealed, classed environment. In order to facilitate that miniature microphones with phantom voltage can be used to produce sufficient sound collection while housing the microphones in something as small as conduit.

Audio collector and analyzers should be local to the machine so that sound may be continually analyzed. 'Local' in this sense is the idea of being able to transmit near real time, the audio to the place of initial analysis. If the infrastructure in place is sufficient, then the location of that analysis could be as distant in miles as possible, but in terms of temporal distance, the analysis should be done locally.

Cloud link. Since multi-machine analysis must be done within a feedback structure, a cloud 36 connection is necessary. That cloud 36 connection could function to transmit the audio into the cloud 36 for further analysis or it could function to push new models to the machine for classification. The connection to the cloud 36 could be by hard network, wired or wireless, or soft connection through update files being brought to the location where hard connections are not possible.

Cloud storage and analyzer. The cloud 36 must be able to collect all classified signatures for retraining and analysis. A central collection facility would allow the identified signatures to be retrained with all past signatures.

Pressure density tubing. Microphones do not have to be placed in the locations of the subsystem, but rather a pressure density microphone much like a stethoscope could be used instead allowing the microphone to be remote to the location and the sound carried through tubing back to the microphone pickup.

Software

Collection software. A locally installed application to collect and store continuous or sampled audio data from each of the N microphones. Each microphone collected audio is stored by subsystem in segments on a continuous or periodic basis.

Local anomaly detection and retraining software. Collected sounds are analyzed for anomalous data against normal operation.

Remote classification and retraining software 38. Anomalies are referred to classification software to distinguish problematic, benign, and unclassified sounds from the heap. Each classified sound is classified against a problem or a benign occurrence.

Anomaly and classification workflow 40. Unclassified audio is routed to those who can analyze either remotely or on site, the sound and provide a classification. Classifications can be updated at a later time. New or changed classifications are fed back into the training process to allow future classification specificity.

The method and operation of the invention will now be explained. The foregoing description of the invention is incorporated herein. Auditory data is collected. One or more microphones systems 14 or microphones 16 are placed in the location of a subsystem of the compressor unit 10 or other location sufficient for analysis. The auditory data is collected into a central processor on site or in the cloud 36. If necessary, a cloud-based processor may be utilized for collection and/processing.

The collected auditory data is compared against "normal" operation. "Normal" may be established either in (i) in a supervised training capacity covering all "like" equipment or (ii) utilizing unsupervised training capacity covering a span of time on "this" equipment establishing "this" normal as typical auditory data unique to a particular installation.

The auditory data is then categorized against known categories of sound. If the categorization is unsuccessful against a known category, the sound will not be fully categorized. Successfully categorized sounds will be placed into an alert workflow. Successfully categorized sounds will also be placed in a continued learning workflow.

Sounds that are unsuccessfully categorized will be placed in a classification workflow or abnormal classification or supervised training 40. The classification workflow will notify individuals responsible for evaluating sounds and determining the causes for the particular unclassified auditory data at issue. Causes will then be described and this particular sound will be assigned a category and a severity matrix such as "none", "informational", "warning", "emergency". The sound, or particular unclassified auditory data, will be processed and bundled into the training model possibly in batch. The new training model will be distributed to each subscribed device.

Figure 10:
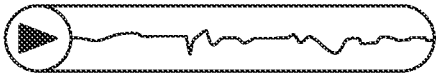
FIG. 10 is a schematic diagram of an exemplary system of the present invention.

As shown in FIG. 8, each location has an assigned number of contacts for issues and identification. These could multiple roles attached. Each classified and unclassified issue will be displayed for the assigned operator, as shown in FIG. 9. Each unclassified sound and classified sound can be classified and the classifications fed into the training operation by those operators with that role, as shown in FIG. 10.

Alerts are provided based on classification. A sound which has been classified with an abnormal classification and a severity matrix will be read for the sound. If the severity matrix requires an alert to proceed, then the sound as well as the category will be directed to registered users to be alerted at that severity on that particular site. If the severity matrix requires an immediate action, an automated action could be performed. If the sound is miscategorized, it will be marked as such and be moved to the "Abnormal Classification Workflow". If the sound is correctly categorized, it will be marked as such and will moved to the "Continued Learning Workflow".

Continued Learning Workflow. Continued learning sounds will be processed and bundled into the training model possibly in batch form. The new training model will be distributed to each subscribed device. Supervised and unsupervised training through auditory data collection, on site train using auditory data collected for a rolling number of hours and evaluates normal against the preceding number of hours of training.

Supervised or Unsupervised Abnormal Operation. Abnormal is a detection of "different" from "normal" across evaluation criteria. Unsupervised training will be suspended. The sound will be categorized using the supervised training categorizations. If the categorization does not match a severity matrix of "none" the sound will enter the Classification Workflow.

EXAMPLE

The operability and efficiency of a method of the present invention and a system constructed in accordance with the present invention is demonstrated by the following example. In an initial pilot test using machine learning, a field test was conducted on a compressor unit on location at a pumping station. Auditory data was recorded from the compressor unit which, unbeknownst to personnel on site or to the test team, had a loose bolt on a flywheel housing. The recorded auditory files were collected and the auditory data converted to three-dimensional waveform images using an ML classification of the Fourier Transformed images. Using a process of sound signature recognition, often called fingerprinting, without the ML CNN, within one hour of operation, the system and method of the present invention identified and classified as abnormal the auditory data produced by the loose bolt on the flywheel housing of the compressor unit. The loose bolt was a critical issue. If the flywheel housing became unaffixed, this condition can cause extreme damage to the compressor unit as well as pose significant safety risks. Finding, classifying and notifying of the condition of the loose bolt within one hour of operation proved both the operability and the efficiency of the system and method of the present invention.

The invention has been described above both generically and with regard to specific embodiments. Although the invention has been set forth in what has been believed to be preferred embodiments, a wide variety of alternatives known to those of skill in the art can be selected with a generic disclosure. Changes may be made in the combination and arrangement of the various parts, elements, steps and procedures described herein without departing from the spirit and scope of the invention as defined in the following claims.

We claim:

1. A system for predictive maintenance for a unit of equipment through auditory detection of anomalies in a hazardous environment, the system comprising:

a microphone system comprising a number of microphones N for collecting auditory data in two dimensional images from the unit of equipment, wherein N is ≥1;

a central processor or storage medium for storing the auditory data in two-dimensional sound files;

a processor for dividing the two-dimensional sound files into segments, transforming the segments of two-dimensional sound files into three-dimensional sound images and conditioning the three-dimensional sound images in an overlay pattern so that each collected item of auditory data is evaluated multiple times; and a library of baseline normal operating sounds comprising the three-dimensional sound images;

wherein anomalies in the hazardous environment are determined by classifying the three-dimensional sound images gathered by the at least one microphone against the library of baseline normal operating sounds to determine whether a sound image is problematic, benign or unclassified.

2. The system of claim 1 wherein the microphone system comprises a microphone that is selected from the group consisting of microphones operating with phantom voltage, microphones operating without phantom voltage, fiber optic microphones and pressure density microphones.

3. The system of claim 2 wherein the microphone system further comprises a hermetically sealed conduit.

4. The system of claim 1 wherein the microphone has 15 dB to 150 dB capability.

5. The system of claim 1 further wherein the library of baseline normal operating sounds is supplemented with a secondary classification of operating sounds collected during operation of the piece of equipment and automatically evaluated and classified as problematic, benign or unclassified.

6. A computer software program stored on a non-transitory computer readable recording medium, which, when executed, performs a method of predicting maintenance for a unit of equipment through auditory detection in a hazardous environment, the method comprising the steps of:

collecting auditory data from the unit of equipment via at least one microphone;

storing the auditory data as two-dimensional sound files in a central processor or storage medium;

dividing the two-dimensional sound files into segments;

transforming the segments of two-dimensional sound files into three-dimensional sound images and conditioning the three-dimensional sound images in an overlay pattern so that each collected item of auditory data is evaluated multiple times; and creating a library of baseline normal operating sounds comprising the three-dimensional sound images for the unit of equipment.

7. The computer software program of claim 6 further performing the step of, after creating the library of baseline normal operating sounds comprising the three-dimensional sound images for the unit of equipment:

collecting additional auditory data from the unit of equipment and storing the additional auditory date in two-dimensional sound files;

dividing the two-dimensional sound files of the additional auditory data into segments and transforming the segments of two-dimensional sound files of the additional auditory data into three dimensional sound images in an overlay pattern so that each item of additional auditory data is evaluated multiple times;

transforming the segments of two-dimensional sound files of additional auditory data into three-dimensional sound images and conditioning the three-dimensional sound images in an overlay pattern so that each collected item of additional auditory data is evaluated multiple times;

automatically analyzing the three-dimensional sound images of the additional auditory data against the baseline of normal operating sounds for the unit of equipment to identify anomalous auditory data.

8. The computer software program of claim 7 wherein the method of predicting maintenance for a unit of equipment through auditory detection further comprises the step of classifying the anomalous auditory data as problematic, benign, or unclassified.

9. The computer software program of claim 8 wherein the method of predicting maintenance for a unit of equipment through auditory detection further comprises the steps of routing unclassified auditory data for analysis by personnel and classifying the unclassified auditory data.

10. The computer software program of claim 7 further comprising the step of creating a continued learning workflow by categorizing the additional auditory data as problematic, benign or unclassified.

11. A method of predicting maintenance for a unit of equipment through auditory detection in a hazardous environment, the method comprising the steps of:

collecting auditory data from the unit of equipment via at least one microphone;

storing the auditory data as two-dimensional sound files in a central processor or storage medium;

dividing the two-dimensional sound files into segments;

transforming the segments of two-dimensional sound files into three-dimensional sound images and conditioning the three-dimensional sound images in an overlay pattern so that each item of auditory data is evaluated multiple times; and creating a library of baseline normal operating sounds comprising the three-dimensional sound images for the unit of equipment.

12. The method of claim 11 wherein:

the equipment comprises operational systems;

the at least one microphone comprises a number of microphones N to collect auditory data, wherein N is ≥1; and wherein the number of microphones N is equal to the number of operational systems.

13. The method of claim 11 wherein the collection of auditory data is continuous.

14. The method of claim 11 wherein the collection of auditory data is periodic.

15. The method of claim 11 wherein the auditory data is stored in a central processor in the cloud.

16. The method of claim 11, after creating a library of baseline normal operating sounds comprising the three-dimensional sound images for the unit of equipment, further comprising the step of:

collecting additional auditory data from the unit of equipment and storing the additional auditory data in two-dimensional sound files;

dividing the two-dimensional sound files from the additional auditory data into segments;

transforming the segments of two-dimensional sound files from the additional auditory data into three-dimensional sound images in an overlay pattern so that each collected item of additional auditory data is evaluated multiple times; and automatically analyzing the additional auditory data against the library of baseline normal operating sounds for the unit of equipment to identify anomalous auditory data.

17. The method of claim 16 wherein the step of automatically analyzing the additional auditory data further comprises the step of classifying the additional auditory data as problematic, benign, and unclassified.

18. The method of claim 17 further comprising the step of automatically routing unclassified auditory data for analysis by personnel.

19. The method of claim 18 further comprising the step of classifying the unclassified auditory data.

20. The method of claim 16 further comprising the step of creating a continued learning workflow by categorizing the additional auditory data as problematic, benign or unclassified.

* * * * *